United States Patent [19]

Huska

[11] Patent Number: 4,907,989

[45] Date of Patent: Mar. 13, 1990

[54] TERMINAL BLOCK INSERT DEVICE SCREW

[76] Inventor: Paul Huska, 739 Moreno Ave., Los Angeles, Calif. 90049

[21] Appl. No.: 314,114

[22] Filed: Feb. 23, 1989

Related U.S. Application Data

[63] Continuation-in-part of Ser. No. 194,537, May 15, 1988, Pat. No. 4,832,628.

[51] Int. Cl.[4] ..... H01R 4/38

[52] U.S. Cl. ..... 439/812; 411/412; 411/417; 411/553; 439/716; 439/815; 439/817; 439/819

[58] Field of Search ..... 439/709, 716, 724, 727, 439/728, 729, 788, 796–798, 811, 812, 813, 815, 817, 819, 835, 836, ; 411/349, 412, 413, 417, 424, 549, 553, 399

[56] References Cited

U.S. PATENT DOCUMENTS

| | | | |
|---|---|---|---|
| 3,246,283 | 4/1966 | Huska | 439/716 |
| 3,304,392 | 2/1967 | Isler | 439/817 X |
| 4,004,846 | 1/1977 | Woertz | 439/724 |
| 4,616,818 | 10/1986 | Vischer | 271/113 |

*Primary Examiner*—Steven C. Bishop
*Attorney, Agent, or Firm*—Cislo & Thomas

[57] ABSTRACT

Improved terminal blocks having inserts comprising a spring-loaded stirrup for clamping electrical conductors, together with a screw for adjusting the clamping action of the stirrup and for releasably locking the stirrup in a fully open position to permit insertion of an electrical conductor, a mechanism for quickly and easily releasing the stirrup when the conductor is in a desired position, and an attachment member for releasably securing the block to a mounting rail.

15 Claims, 3 Drawing Sheets

TERMINAL BLOCK INSERT DEVICE SCREW

BACKGROUND OF THE INVENTION

This is a continuation-in-part application of application Ser. No. 07/194,537, filed on May 15, 1988.

This invention relates to terminal connection of electrical conductors and particularly directed to an insertable cage assembly device for use in connecting electrical conductors in a terminal block.

In the past, numerous devices have been proposed for securing electrical conductors in a terminal block. Clearly the most pertinent is U.S. Pat. No. 3,246,283, issued Apr. 12, 1966 to Paul Huska, the inventor in the present case. However, the '283 patent discloses a device wherein securing of the electrical conductor (or conductors) within the terminal block is dependent upon the craftsman turning a screw to open the terminal block to receive the conductor and, subsequently, reversing the screw to clamp the conductor end, while holding the conductor end in the desired position within the terminal block. The above is an over simplification of the work to be performed.

Terminal blocks are usually used to secure electrical or electronic conductors in communication systems, instrumentation systems and control systems from the simple to the most complex. It is obvious, therefore, that the highest degree of reliability be secured for conductor terminations. The integrity of any system is greatly contingent upon workmanship and adequacy of the terminal blocks.

Furthermore, mechanical motion, vibration, temperature variations, cold flow characteristics of materials used, realignment of conductor strands, especially where more than one conductor occupies the same "clamp space" affect proper connection. Under such conditions the reliability of the electrical/electronic systems noted above is of great concern. Indeed, life, property and equipment may be in jeopardy.

Moreover circuitry could be adversely affected due to changes in resistance values of a given circuit. Especially critical, is the problem of a conductor withdrawing from a terminal block because of the loosening actions described above. This occurs in many instances where conductors are installed under tension. Hence, when the force is great enough, a conductor will pull out and away from its terminal block. These kinds of occurrences, and they are frequent, can be disastrous. The present invention overcomes these problems and provides improved means for attaching the terminal block to a mounting rail.

A search in the U.S. Patent Office has revealed various other patents which are generally related to the present invention. The most pertinent patents found in the search are the following:

| U.S. Pat. No. | Inventor | Issue Date |
|---|---|---|
| 1,439,657 | R. Zollner | Dec. 19, 1922 |
| 1,642,042 | J. L. Polk | Sept. 13, 1927 |
| 2,166,346 | H. A. Douglas | July 18, 1939 |
| 3,001,173 | A. H. Swengel | Sept. 19, 1961 |
| 3,152,855 | E. C. Crowther | Oct. 13, 1964 |
| 3,304,392 | E. W. Isler | Feb. 14, 1967 |
| 3,915,545 | Y. Saito | Oct. 28, 1975 |
| 3,989,345 | C. P. DeVito | Nov. 2, 1976 |
| 4,476,400 | T. Jo et al | Oct. 9, 1984 |
| 4,643,513 | C. B. Martin | Feb. 17, 1987 |

The Isler, Saito, Swengel, Martin and Zollner patents each suggests the use of spring clamping means. However, none of these provides a quickly releasable means for locking the clamping means in a fully open position to facilitate insertion of a conductor therein. The patents of Polk, Douglas, Crowther, DeVito and Jo are generally related to the subject matter of the present invention, but are believed to be less pertinent than those patents referred to above.

Over the course of prosecution of the parent application, several patents having screw means were cited as pertinent by the Examiner as follows:

| U.S. Pat. No. | Inventor | Issue Date |
|---|---|---|
| 2,011,861 | H. Knumann | Aug. 1935 |
| 3,246,283 | P. Huska | April 12, 1966 |
| 3,304,392 | E. W. Isler | Feb. 14, 1967 |
| 4,004,846 | H. Woertz | Jan. 25, 1977 |

Each of these patents disclose a screw means for actuating or releasing an electrical connection. However, none of the patents disclose a screw means with the unique configuration of the invention which allows quick release and quick securement with a minimum of screw means rotation.

Another search of the U. S. Patent Office specifically directed to the screw of the invention disclosed the following U. S. Patents:

| U.S. Pat. No. | Inventor | Issue Date |
|---|---|---|
| 389,028 | J. P. Wallace | Sept. 4, 1888 |
| 452,640 | P. A. Gerry | May 19, 1891 |
| 1,052,179 | C. J. Robley | Feb. 4, 1913 |
| 1,987,474 | A. E. Grant | Jan. 8, 1935 |
| 2,445,396 | H. D. Gursky | July 20, 1948 |
| 2,929,474 | S. Boardman | Mar. 22, 1960 |
| 4,235,560 | V. R. Schimmel | Nov. 25, 1980 |
| 4,616,818 | P. Vischer | Oct. 14, 1986 |
| 4,734,061 | H. E. Randall, Jr. et al | May 29, 1988 |

A more in-depth description of each of the more pertinent patents follows.

The Schimmel 4,235,560 patent discloses a transition bolt 12, which is adapted to pass through selected slots 38, inside rails of a reinforcing frame. The transition bolt 13, shown in FIG. 3, is of one-piece character and comprises a flat-sided steel member which may be formed of flat bar stock. The bolt 12 has an enlarged head 52, at one end thereof and an intermediate shoulder portion 54 of intermediate or reduced size, and a further reduced shank portion 56 at its other end. The shoulder and shank portion 52 and 54 are adapted respectively to extend through the horizontal extending slot 33.

The Vischer 4,616,818 patent is directed to a device for feeding cardboard carton blanks to a conveyer. An adjusting screw means 200 has a relatively small diameter threaded portion 202 and a second relatively large diameter threaded portion 204 for purposes of engaging different surfaces. The head portion of the screw 200 includes a thumb wheel portion 210 which is located adjacent a hexagonal end portion 212. However, a larger second threaded portion 204 is not provided with opposing flat surfaces.

The Grant 1,987,474 patent is directed to a screw adapted to cut an internal thread within a bore. The screw is provided with a slotted head 11 and a shank portion 10 which is formed with a pair of opposing flat surfaces 12 and connecting rounded surfaces 13 on which ridges 14 are pressed, forming threads on the rounded portion.

The Randall 4,734,061 patent is directed to a terminal block for use in terminating telecommunications wire. The threaded plug 13 is provided with an extending head 15 on one end of a threaded end insert 33 provided on the opposing end. However, the threaded insert 33 is provided with only a single threaded portion.

The Boardman 2,929,474 patent is directed to a threaded fastener adapted to provide a means for retaining the fastener in position to prevent loss or displacement during assembly. A bolt 13 is provided with an upper threaded section 15 and a lower threaded end portion 17. The upper threaded portion 15 engages a speed nut 29 for retaining the bolt 13 with a bearing block 23, while the lower threaded portion 17 passes through a base unit 40 to engage a nut 45.

The Gursky 2,445,396 patent is directed to a clamping device to secure a sheet of sandpaper to a cylinder. A screw member 18 is provided with a differential screw thread arrangement wherein the forward portion 18*a* is provided with a predetermined thread arranged in one direction, while a larger second portion 18*b* is provided with an oppositely directly finer thread. Thus, the screw 18 provides a means for engaging different surfaces to provide mechanical clamping therebetween.

The remaining patents found were all directed to other screws having one or more of the elements of the searched invention in common. However, none of them are any more pertinent than those specifically described.

Each of these patents, again fail to disclose the unique aspects of the instant invention which overcomes the problems of laborious turning of a screw means to engage or release a surface of a plate or body.

OBJECTS AND SUMMARY OF THE INVENTION

None of the prior art patents suggests a terminal block having a spring-loaded stirrup for clamping the conductor in place, together with a screw means for additional adjusting of the clamping action of the stirrup. Moreover, none of the references provide means for locking the stirrup in a fully open position to permit insertion of the conductor, yet allows the stirrup to be released, quickly and easily with a 90° turn, once the conductor or conductors are in the desired position.

Furthermore, the terminal block of the present invention provides improved means for releasably securing the terminal block to a mounting rail.

Accordingly, it is an object of the present invention to provide improved terminal blocks.

Another object of the present invention is to provide improved terminal blocks having inserts comprising spring-loaded stirrup means for clamping electrical conductors, together with screw means for adjusting the clamping action of the stirrup and for releasably locking the stirrup in a fully open position to permit insertion of an electrical conductor.

Another object of the present invention is to provide a terminal block connector which requires little or no screwing action to become fully opened or clamped to effectively preclude conductor loosening and which requires little space.

A further object of the present invention is to provide improved terminal blocks having inserts comprising spring-loaded stirrup means for clamping electrical conductors easily and positively, together with a screw means for further adjustment of the clamping action of the stirrup and for releasably locking the stirrup in a fully open position to permit insertion of an electrical conductor and means for quickly and easily releasing the stirrup when the conductor is in a desired position which can be visually determined.

An additional object of the present invention is to provide improved terminal blocks having means for releasably securing said block to a mounting rail.

Another object of the present invention is to provide a terminal block connector with a screw that cannot be lost, but instead held captive.

Another object of the present invention is to provide a terminal block connector which will not deform even though heavy springs are used within to insure a strong clamping force.

A specific object of the present invention is to provide improved terminal blocks having inserts comprising spring-loaded stirrup means for clamping electrical conductors, together with screw means for adjusting the clamping action of the stirrup and for releasably locking the stirrup in a fully open position to permit insertion of an electrical conductor and means for quickly and easily releasing the stirrup when the conductor is in a desired position, and attaching means for releasably securing the block to a mounting rail.

These and other objects and features of the present invention will be apparent from the following detailed description taken with reference to the figures of the accompanying drawing.

DETAILED DESCRIPTION OF THE INVENTION

Figure 1:
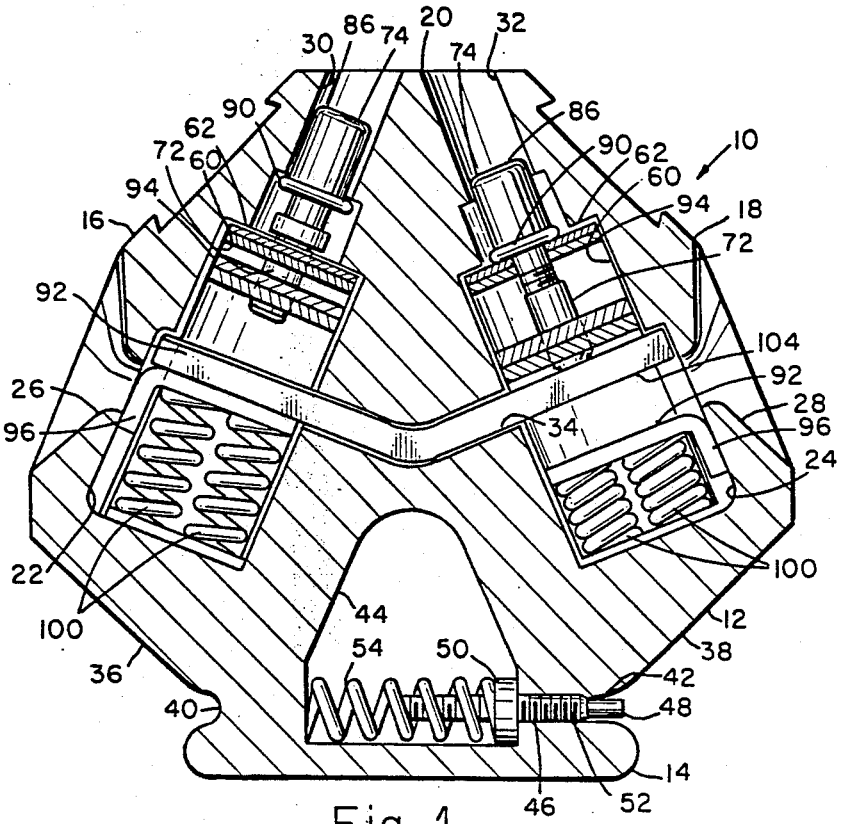
FIG. 1 is a front elevation of the terminal block of the present invention shown with the front wall of the cage removed for clarity.

In that form of the present invention chosen for purposes of illustration in the drawings, FIG. 1 shows a terminal block, indicated generally at 10, having a body 12 which is generally in the shape of a truncated triangle. Thus, the body 12 has a base 14 and a pair of converging sides 16 and 18 with a flattened top 20 that is somewhat smaller than the base 14. The body 12 may be formed of any suitable electrically insulating material. The body 12 has two generally rectangular recesses 22 and 24 formed therein and each of the recesses has its vertical axis extending generally parallel to the adjacent side 16 or 18 of the body 12. Each of the sides 16 and 18 is formed with an opening, as seen at 26 or 28, communicating with the adjacent side of a respective one of the recesses 22 and 24. Moreover, each of the recesses 22 and 24 is provided with an axial opening communicating with the top 20, as seen at 30 and 32. Also, a generally V-shaped recess 34 is formed in the body 12 and connects the recesses 22 and 24.

The lower portions of the sides 16 and 18 incline inwardly to meet the base 14, as seen at 36 and 38 and form recesses 40 and 42 just above the base 14. A central opening 44 is formed in the body 12 between the recesses 40 and 42 and a lateral bore 46 communicates the central opening 44 with the recess 42.

As shown, a detent member 48 is slideably located in the bore 46 and is formed with a flange portion 50 which abuts the edge of the opening 44 adjacent the bore 46 and has a shaft portion 52 which projects through the bore 46 and extends some distance into the recess 42. A spring 54 is located within the opening 44 of the body 12 and serves to urge the detent member 48 into position.

Figure 13:
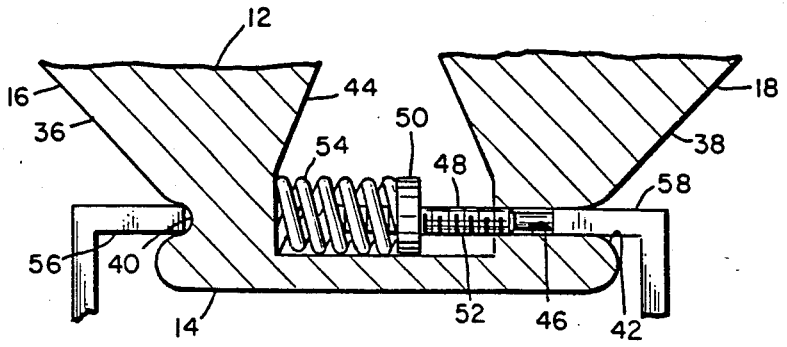
FIG. 13 is a view similar to that of FIG. 12 showing the base member fully secured to the mounting rail.
Figure 12:
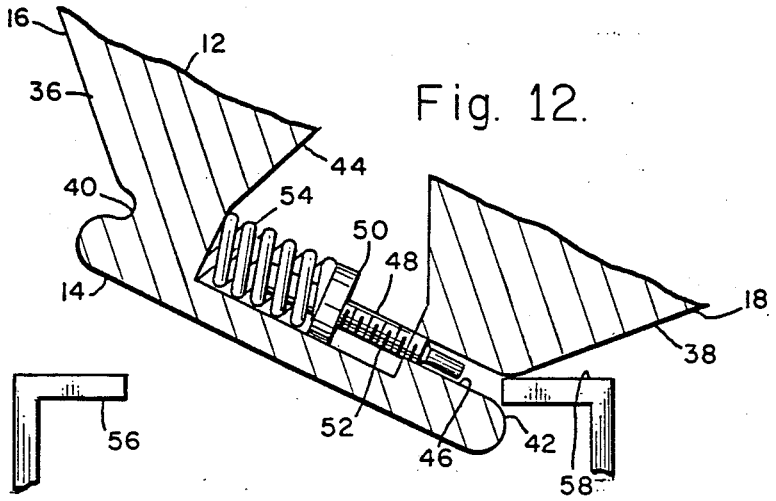
FIG. 12 is an enlarged detail showing the base member of the terminal block of FIG. 1 partially positioned on a mounting rail.

In use, the terminal block 12 is secured between a pair of opposed, spaced-apart flanges or rails, as seen at 56 and 58 in FIGS. 12 and 13. The flanges 56 and 58 may be supported by a generally U-shaped channel member, as shown in Applicant's earlier patent. However, the details of the support of the flanges 56 and 58 is not pertinent to the present invention. In order to secure the terminal block 12 to the flanges 56 and 58, the block 12 is tilted, as seen in FIG. 12 and the end of flange 58 is inserted into the recess 42 of block 12. As the end of the flange 58 is inserted into recess 42, it engages the outer end of detent 48 and forces the detent 48 to move inwardly along the bore 46 against the action of the spring 54.

When the flange 58 has been inserted sufficiently far into recess 42, the base 14 of the block 12 can be rotated to the position shown in FIG. 13, allowing the end of base 14 to clear the end of flange 56 and allowing the end of flange 56 to be inserted into recess 40. This permits some relaxation of the compression of spring 54. However, the spring 54 will still apply some pressure against detent 48 and will serve to effectively lock the terminal block 12 in position between the flanges 56 and 58. To remove the terminal block 12, the block is forced toward flange 58 against the action of the spring 54, causing the detent 48 to retract into the bore 46 and permitting the base 14 of the terminal block 12 to be rotated again to the position of FIG. 12 and, hence, to be removed from the flanges 56 and 58.

Figure 8:
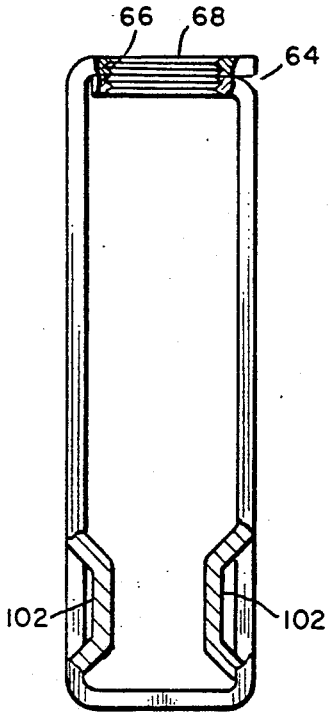
FIG. 8 is a side view of one of the cages of the terminal block of FIG. 1 with a portion of the top thereof shown broken away for clarity.
Figure 9:
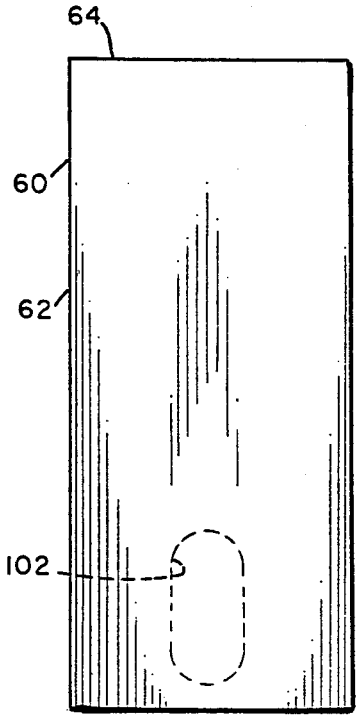
FIG. 9 is a front view of the cage of FIG. 8.
Figure 10:
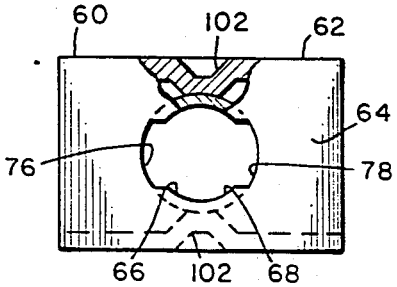
FIG. 10 is a top view of the cage of FIG. 8 with a portion of the side shown broken away for clarity.

Turning now to a detailed description of the terminal block 12, each of the rectangular recesses 22 and 24 contains a clamping member, indicated generally at 60. The clamping members 60 are identical and each comprises a generally rectangular cage 62, as best seen in FIGS. 8, 9 and 10. As shown, each of the cages 62 is a generally rectangular, open-sided structure, preferably formed of relatively rigid material, such as metal, and may be extruded or formed of sheet metal which is lapped at the top to provide a thicker layer, as seen at 64. However, cages 62 may be of unitary construction without the sheet metal being lapped at the top.

Figure 5:
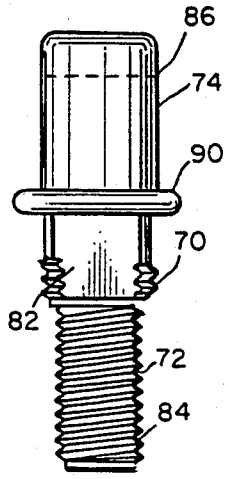
FIG. 5 is a side view of one of the adjusting screws of the terminal block of FIG. 1.
Figure 6:
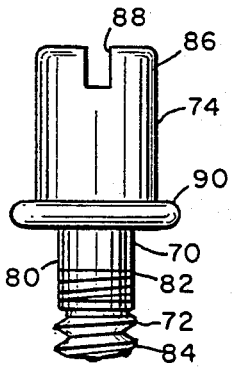
FIG. 6 is a front view of the upper portion of the adjusting screw of FIG. 5.
Figure 7:
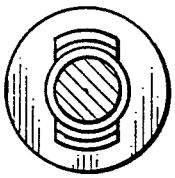
FIG. 7 is a bottom view of the screw of FIG. 5.

An axial bore 66 extends through the top 64 and is threaded (one or many threads), as seen at 68, to mate with the threaded inner diameter of the upper portion 70 of the shaft 72 of a screw member 74, as seen in FIGS. 5, 6 and 7. The threaded, inner diameter may have only a single thread sufficient to engage the screw. However, the bore 66 is formed with lateral extensions, as seen at 76 and 78, which eliminate the threads 68 in those areas. Correspondingly, the upper portion 70 of the screw 74 has flattened areas 80 and 82 formed on the sides thereof, as seen in FIGS. 5 and 6, which also eliminate the threads in those areas. The lower portion 84 of the shank 72 of screw 74 is of lesser diameter than the upper portion 70, as best seen in FIG. 5, and is threaded throughout the length thereof. The pitch of the threads of the upper portion 70 and lower portion 84 of the screw 74 are identical.

The diameter of the lower portion 84 of the screw 74 is such that the portion 84 of the screw 74 can pass freely through the bore 66 of the cage 62. In contrast, the upper portion 70 of the screw 74 will pass through the bore 66 only when the threaded portions thereof are aligned with the extensions 76 and 78 of the bore 66. When the screw 74 is rotated to cause the threads of the upper portion 70 to engage the thread or threads 68 of the cage 62, the screw 74, cage 62, and stirrup assembly will be locked and maintained in that position. If the portion 70 of screw 74 is pushed through the cage 62 and then rotated 90°, the screw-cage-stirrup assembly will be locked in that position. Above the upper portion 70, the screw 74 is provided with a head 86 which is dimensioned to project into one of the bores 30 or 32 and has a slot 88 formed in the upper surface thereof to permit rotation of the screw 74 by means of a conventional screwdriver, for example, not shown. A radially projecting flange 90 is provided on the screw 74 between the upper portion 70 and the head 86 and serves to engage the upper end of the recess 22 or 24 to limit upward movement of the screw 74.

Figure 4:
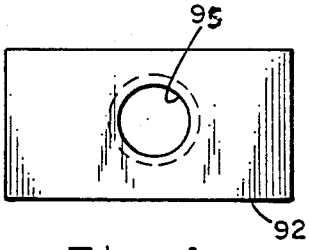
FIG. 4 is a top view of the stirrup of FIG. 2.
Figure 3:
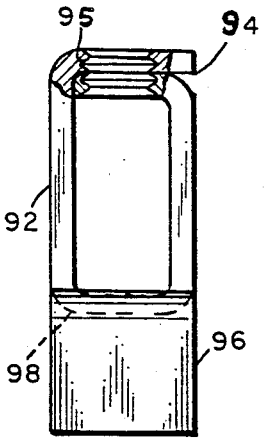
FIG. 3 is a front plan view of one of the stirrups of the terminal block of FIG. 1 with a portion shown broken away for clarity.
Figure 2:
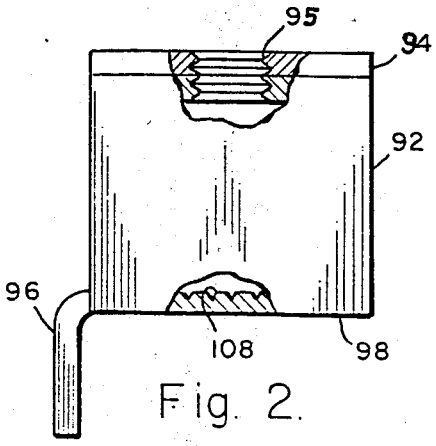
FIG. 2 is a side view of one of the stirrups of the terminal block of FIG. 1 with portions shown broken away for clarity.

A generally rectangular, open-sided stirrup member 92, shown in FIGS. 2, 3 and 4, is slideably mounted within the cage 62, as seen in FIG. 1, and may be formed of rigid material, such as metal, which may be extruded or formed of sheet material which is overlapped at the top to provide a thickened area, as seen at 94 in FIGS. 2 and 3. The top 94 of the stirrup 92 is provided with a central bore 95 which is sized and threaded to mate with the lower portion 84 of the screw 74. In addition, the stirrup 92 is formed with a downwardly projecting flange 96 extending from the bottom 98 of the stirrup 92 on the side adjacent the respective one of the openings 26 or 28. As noted above, the stirrup 92 is slideably mounted within the cage 62 and a pair of springs 100 are positioned beneath the bottom 98 of the stirrup 92 and the inside bottom of the cage 62 to normally urge the stirrup 92 upwardly. The springs may be of a different number or type as shown herein, so long as the springs function similarly as the springs shown. If desired, indentations 102 may be provided generally centrally of the front and rear walls of the cage 62 adjacent the lower ends thereof, as seen in FIGS. 8 and 9, to retain the springs 100 in their proper positions and preclude interleafing of the springs 100.

Figure 11:
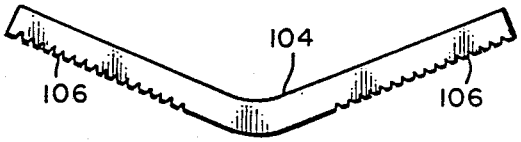
FIG. 11 is a front view of the bus bar of the terminal block of FIG. 1.

Finally, a generally V-shaped bus bar 10 is positioned in the recess 34 and extends through the recesses 22 and 24. The bus bar 104 is formed of electrically conductive material, such as copper, and, if desired may be formed with knurling grooves or points, as seen at 106 in FIG. 11, to improve or enhance electrical contact between the bus bar 104 and an electrical conductor clamped by the terminal block 12. The knurling helps to fracture possible layers of deleterious material on the conductor. Other conductive, but corrosive resistant materials may be used where corrosive environments are expected. Similarly, if desired, the inside of the bottom 98 of the stirrup 92 may be knurled, pointed or grooved for the same purpose, as seen at 108 in FIG. 2. It should be acknowledged by the person ordinarily skilled in the art that various configurations of knurling or indentation may be used to grip the conductor without damaging the conductor.

In use, the springs 100 will normally urge the stirrup 92 to the position shown in recess 22 on the left side of the terminal block 12 of FIG. 1. In this position, the flange 96 of the stirrup will block the opening 26 and, hence, will prevent inadvertent admission of foreign objects into the interior of the terminal block 12 or the erroneous insertion of a conductor where lack of visibility of the, block exists.

To clamp an electrical conductor into the terminal block 12, screw 74 must be rotated to a position such that the threads of the upper portion 70 are aligned with the extensions 76 and 78 of the bore 66 in the top 64 of the cage 62. The screw 74 is then pushed downward and, since the lower portion 84 of the screw 74 is mated with the threaded bore 95 in the top 94 of the stirrup 92, the stirrup 92 is moved against the action of the springs 100 to the position seen in recess 24 on the right side of the terminal block 12 of FIG. 1.

The screw 74 is then rotated to cause the threads of sheet metal cage 62 to thread into threads of the upper portion 70 of the screw 74 because the thickness or gage of sheet metal used is preferably complementary with the pitch of the threading of screw 74. However, as shown in the drawings, the upper portion 70 of the screw 74 engages the threads 68 of bore 66 in the top 64 of the cage 62 to lock the stirrup 92 in the open position. Moreover, the threaded portion 70 of screw 74 may be pushed completely through the top 64 of cage 62 at which time, by rotating screw 74, the stirrup assembly will be engaged to maintain an open position. Also, the screw 74 may be pushed completely through the top 64 of the cage 62. By pushing down on the screw 74 and rotating the screw 74, the top 94 of the stirrup 92 may be engaged to an open position. As seen on the right side of FIG. 1, this action permits the end of an electrical conductor or conductors, not shown, to be inserted through opening 24 into the space between the bottom of the bus bar 104 and the inside of the bottom 98 of the stirrup 92.

Thereafter, by simply rotating screw 74 to align the threads of the upper portion 70 of the screw 74 with the extensions 76 and 78 of the bore 66 in the top 64 of the cage 62, the springs 100 are released to urge the stirrup 92 upwardly, causing the conductor end to be clamped between the bus bar 104 and the inside bottom 98 of the stirrup 92. Clamping pressure on the conductors to be held can be increased, if desired, by further rotating the screw 74 in a direction forcing the stirrup 92 to be drawn towards the bus bar 104. The tension of this clamping action can be adjusted, if necessary, by rotating the screw 74 to cause the threads of the lower portion 84 to be driven into or out of the bore 95 in the top 94 of the stirrup 92. Different springs 100 having different tensions can be utilized to increase the clamping force on the conductor to prevent it from being pulled free.

To mount the terminal block 12 on a mounting rail, one of the flanges 58 of the mounting rail is inserted into the recess 42 between the side 18 and base 14 of the terminal block 12, as seen in FIG. 12, and serves to force the detent member 48 rearwardly in the bore 46 against the action of spring 54. The terminal block 12 is then rotated to a position shown in FIG. 13, where flange 56 of the mounting rail can engage recess 40 between side 16 and base 14 of the terminal block 12 and the pressure against detent 48 is relaxed. Thereafter, the action of spring 54 against detent 48 and, hence against flange 58 will serve to lock the terminal block 12 in position. To remove the terminal block 12, the block is forced toward flange 58 until flange 56 no longer engages recess 40 whereupon the terminal block 12 is rotated to the position seen in FIG. 12 and can be removed.

Obviously, numerous variations and modifications may be made to the terminal block without departing from the present invention. Therefore, it should be clearly understood that the form of the present invention described above and shown in the accompanying drawings is illustrative only and is not intended to limit the scope of the present invention.

I claim:

1. A terminal block screw or the like for engaging first inner walls of a first opening in a first surface of a first body while selectively engaging second inner walls of a second opening in a second surface of a second body, comprising an upper portion and a lower portion with different geometries which allow quick and releasable engagement of said screw to the first body by engaging the first inner walls to the first opening of the first surface.

2. A terminal block screw or the like as claimed in claim 1, wherein said upper portion having threading interrupted by at least one flat surface of a predetermined width along an axial length of said upper portion, and sized to engage the first inner walls of the first opening of the first surface of the first body.

3. A terminal block screw screw or the like as claimed in claim 2, further comprising a head of a larger diameter than said upper portion and integrally formed at one end of said upper portion opposite said lower portion.

4. A terminal block screw or the like as claimed in claim 3, wherein said head has a diameter greater than a diameter of the first opening in the first surface of the first body, said upper portion having a cross section substantially complementing the first opening, wherein said upper portion can pass through said first opening when properly aligned with the first opening, wherein the size of said head prevents said head from passing through the first opening irrespective of rotational movement of said head.

5. A terminal block screw or the like as claimed in claim 4, having a second flat surface of a predetermined width along said axial length of said upper portion opposite said one flat surface.

6. A terminal block screw or the like as claimed in claim 5, wherein said lower portion has an axial length longer than said axial length of said upper portion.

7. A terminal block screw or the like as claimed in claim 6, wherein said lower portion has a smaller diameter than said upper portion, and wherein said lower portion having threading sized to selectively engage the second walls of the second opening in the second surface of the second body.

8. A terminal block screw or the like as claimed in claim 7, wherein said threading of said lower portion is uninterrupted.

9. A terminal block screw or the like as claimed in claim 8, wherein said threading of said lower portion has a substantially similar width for each of said threads as said threading of said upper portion for each of said threads.

10. A terminal block screw or the like as claimed in claim 9, wherein said threading of said lower portion has an orientation corresponding to an orientation of said threading of said upper portion.

11. A terminal block screw or the like as claimed in claim 10, wherein said head defines an engageable slot or the like on an exposed end, so as to allow engagement of said head for rotating said head, and thereby rotating said screw.

12. A quick-release/engagement securing device comprising a screw means for rotatively engaging or releasing and a plate means for retaining or releasing said screw means, wherein said screw means comprising an enlarged head, a threaded midsection and a threaded end section, said plate means defining an opening engageable by said threaded midsection and sized to allow said threaded end section to pass therethrough, wherein said enlarged head can be rotated to engage or disengaged said plate means depending upon orientation of said enlarged head.

13. A quick-release/engagement device as claimed in claim 12, wherein said threaded midsection of said screw means has at least one flat surface of a predetermined width and length extending axially to said screw means and said threaded midsection, and wherein said opening of said plate means defining a shape substantially corresponding to a cross section of said threaded midsection of said screw means, thereby allowing said threaded midsection to pass through said opening when said midsection is properly and rotatively aligned with said opening.

14. A quick-release/engagement device as claimed in claim 13, wherein said midsection having a second flat surface of a predetermined length and width extending axially to said screw means and said threaded midsection and opposite said one flat surface.

15. A quick-release/engagement device as claimed in claim 14, wherein threading on said midsection and threading on said end section are similarly oriented to allow engagement or disengagement when said head is rotated accordingly.

* * * * *